US006658930B2

(12) United States Patent
Abbas

(10) Patent No.: US 6,658,930 B2
(45) Date of Patent: Dec. 9, 2003

(54) METAL PAD FOR DOWNHOLE FORMATION TESTING

(75) Inventor: Arian Abbas, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 10/067,169

(22) Filed: Feb. 4, 2002

(65) Prior Publication Data

US 2003/0145652 A1 Aug. 7, 2003

(51) Int. Cl.[7] ..... E21B 49/10; E21B 49/00

(52) U.S. Cl. ..... 73/152.26; 73/863.85; 73/864.73; 166/264.8

(58) Field of Search ..... 73/152.26, 152.24, 73/152.55, 863.85, 864.73, 866.5; 166/264, 254.2; 175/50

(56) References Cited

U.S. PATENT DOCUMENTS

| | | | | |
|---|---|---|---|---|
| 3,076,334 A | * | 2/1963 | Wiley | 73/155 |
| 3,530,933 A | | 9/1970 | Whitten | 166/100 |
| 3,565,169 A | | 2/1971 | Bell | 166/100 |
| 3,811,321 A | | 5/1974 | Urbanosky | 73/155 |
| 3,813,936 A | | 6/1974 | Urbanosky et al. | 73/155 |
| 3,858,445 A | | 1/1975 | Urbanosky | 73/155 |
| 3,859,850 A | | 1/1975 | Whitten et al. | 73/155 |
| 3,859,851 A | | 1/1975 | Urbanosky | 73/155 |
| 3,864,970 A | | 2/1975 | Bell | 73/155 |
| 3,924,463 A | | 12/1975 | Urbanosky | 73/155 |
| 3,934,468 A | | 1/1976 | Brieger | 73/155 |
| 3,952,588 A | | 4/1976 | Whitten | 73/155 |
| 4,210,018 A | | 7/1980 | Brieger | 166/100 |
| 4,287,946 A | | 9/1981 | Brieger | 166/100 |
| 4,339,948 A | * | 7/1982 | Hallmark | 73/155 |
| 4,416,152 A | | 11/1983 | Wilson | 73/155 |
| 4,434,653 A | | 3/1984 | Montgomery | 73/151 |
| 4,507,957 A | | 4/1985 | Montgomery et al. | 73/151 |
| 4,513,612 A | | 4/1985 | Shalek | 73/155 |
| 4,593,560 A | | 6/1986 | Purfurst | 73/155 |
| 4,745,802 A | * | 5/1988 | Purfurst | 73/155 |
| 4,843,878 A | | 7/1989 | Purfurst et al. | 73/155 |
| 4,845,982 A | | 7/1989 | Gilbert | 73/151 |
| 4,860,580 A | * | 8/1989 | DuRocher | 73/152.26 |
| 4,860,581 A | * | 8/1989 | Zimmerman | 175/50 |
| 4,879,900 A | | 11/1989 | Gilbert | 73/155 |
| 4,884,439 A | | 12/1989 | Baird | 73/155 |
| 4,890,487 A | | 1/1990 | Dussan V. et al. | 73/152 |
| 4,936,139 A | * | 6/1990 | Zimmerman | 73/155 |
| 4,941,350 A | | 7/1990 | Schneider | 73/155 |
| 4,951,749 A | | 8/1990 | Carroll | 166/264 |
| 5,056,595 A | | 10/1991 | Desbrandes | 166/100 |

(List continued on next page.)

FOREIGN PATENT DOCUMENTS

| | | |
|---|---|---|
| EP | 0 697 501 | 8/1995 |
| GB | 2 304 906 A | 3/1997 |

OTHER PUBLICATIONS

UK Search Report for Appln. No. GB 0302562.4 dated Apr. 10, 2003.

*Primary Examiner*—Hezron Williams
*Assistant Examiner*—David J. Wiggins
(74) *Attorney, Agent, or Firm*—Conley Rose, P.C.

(57) ABSTRACT

Methods and apparatus for isolator pad assemblies used in formation testing equipment. The pad comprises a primarily metallic pad member and a retractable resilient sealing member. The resilient sealing member is maintained in a retracted, protected position until extended to seal against the wellbore. When extended the metallic pad pushes into the mudcake until a raised ring of material on the surface of the pad contacts the formation. Once the pad is in place, the resilient sealing member, which is molded to an extending metal sleeve, is extended and contacts the mudcake to form a primary seal. With the primary and secondary seals energized, a fluid sample can be collected from the formation without contamination from wellbore fluids.

15 Claims, 2 Drawing Sheets

U.S. PATENT DOCUMENTS 5,095,745 A 3/1992 Desbrandes ..... 73/152
5,101,907 A 4/1992 Schultz et al. ..... 166/386
5,230,244 A 7/1993 Gilbert ..... 73/155
5,231,874 A 8/1993 Gilbert ..... 73/151
5,233,866 A 8/1993 Desbrandes ..... 73/155
5,238,070 A 8/1993 Schultz et al. ..... 166/386
5,265,015 A 11/1993 Auzerais et al. ..... 364/421
5,269,180 A 12/1993 Dave et al. ..... 73/152
5,279,153 A 1/1994 Dussan V. et al. ..... 73/155
5,303,775 A 4/1994 Michaels et al. ..... 166/264
5,317,932 A * 6/1994 Westlake, III et al. ... 73/864.73
5,329,811 A 7/1994 Schultz et al. ..... 73/155
5,335,542 A 8/1994 Ramakrishnan et al. ..... 73/152
5,377,755 A 1/1995 Michaels et al. ..... 166/264
5,473,939 A 12/1995 Leder et al. ..... 73/155
5,549,159 A 8/1996 Shwe et al. ..... 166/250.02
5,587,525 A 12/1996 Shwe et al. ..... 73/15.52
5,602,334 A 2/1997 Proett et al. ..... 73/152.05
5,622,223 A 4/1997 Vasquez ..... 166/264
5,635,631 A 6/1997 Yesudas et al. ..... 73/61.46
5,644,076 A 7/1997 Proett et al. ..... 73/152.41
5,907,110 A * 5/1999 Garcia et al. ..... 73/864.74
6,047,239 A 4/2000 Berger et al. ..... 702/9
6,332,369 B1 * 12/2001 Bombe et al. ..... 73/864.73

* cited by examiner

METAL PAD FOR DOWNHOLE FORMATION TESTING

FIELD OF THE INVENTION

This invention relates to downhole tools used to acquire and test a sample of fluid from a formation. More particularly, this invention relates to a sealing arrangement that creates a seal between a sample probe and a formation in order to isolate the probe from wellbore fluids.

BACKGROUND OF THE INVENTION

Formation testing tools are used to acquire a sample of fluid from a subterranean formation. This sample of fluid can then be analyzed to determine important information regarding the formation and the formation fluid contained within, such as pressure, permeability, and composition. The acquisition of accurate data from the wellbore is critical to the optimization of hydrocarbon wells. This wellbore data can be used to determine the location and quality of hydrocarbon reserves, whether the reserves can be produced through the wellbore, and for well control during drilling operations.

Formation testing tools may be used in conjunction with wireline logging operations or as a component of a logging-while-drilling (LWD) or measurement-while-drilling (MWD) package. In wireline logging operations, the drill string is removed from the wellbore and measurement tools are lowered into the wellbore using a heavy cable (wireline) that includes wires for providing power and control from the surface. In LWD and MWD operations, the measurement tools are integrated into the drill string and are ordinarily powered by batteries and controlled by either on-board or remote control systems.

To understand the mechanics of formation testing, it is important to first understand how hydrocarbons are stored in subterranean formations. Hydrocarbons are not typically located in large underground pools, but are instead found within very small holes, or pores, within certain types of rock. The ability of a formation to allow hydrocarbons to move between the pores, and consequently into a wellbore, is known as permeability. Similarly, the hydrocarbons contained within these formations are usually under pressure and it is important to determine the magnitude of that pressure in order to safely and efficiently produce the well.

During drilling operations, a wellbore is typically filled with a drilling fluid ("mud"), such as water, or a water-based or oil-based mud. The density of the drilling fluid can be increased by adding special solids that are suspended in the mud. Increasing the density of the drilling fluid increases the hydrostatic pressure that helps maintain the integrity of the wellbore a and prevents unwanted formation fluids from entering the wellbore. The drilling fluid is continuously circulated during drilling operations. Over time, as some of the liquid portion of the mud flows into the formation, solids in the mud are deposited on the inner wall of the wellbore to form a mudcake.

The mudcake acts as a membrane between the wellbore, which is filled with drilling fluid, and the hydrocarbon formation. The mudcake also limits the migration of drilling fluids from the area of high hydrostatic pressure in the wellbore to the relatively low-pressure formation. Mudcakes typically range from about 0.25 to 0.5 inch thick, and polymeric mudcakes are often about 0.1 inch thick. The thickness of a mudcake is generally dependent on the time the borehole is exposed to drilling fluid. Thus, in MWD and LWD applications, where a section of the borehole may be very recently drilled, the mudcake may be thinner than in wireline applications.

The structure and operation of a generic formation tester are best explained by referring to FIG. 1. In a typical formation testing operation, a formation tester 100 is lowered to a desired depth within a wellbore 102. The wellbore 102 is filled with mud 104, and the wall of wellbore 102 is coated with a mudcake 106. Once formation tester 100 is at the desired depth, it is set in place by extending a pair of feet 108 and an isolation pad 110 to engage the mudcake 106. Isolation pad 110 seals against mudcake 106 and around hollow probe 112, which places internal cavity 119 in fluid communication with formation 122. This creates a fluid pathway that allows formation fluid to flow between formation 122 and formation tester 100 while isolated from wellbore fluid 104.

In order to acquire a useful sample, probe 112 must stay isolated from the relative high pressure of wellbore fluid 104. Therefore, the integrity of the seal that is formed by isolation pad 110 is critical to the performance of the tool. If wellbore fluid 104 is allowed to leak into the collected formation fluids, an non-representative sample will be obtained and the test will have to be repeated.

Isolation pads that are used with wireline formation testers are generally simple rubber pads affixed to the end of the extending sample probe. The rubber is normally affixed to a metallic plate that provides support to the rubber as well as a connection to the probe. These rubber pads are often molded to fit with the specific diameter hole in which they will be operating. These types of isolator pads are commonly molded to have a contacting surface that is cylindrical or spherical.

While conventional rubber pads are reasonably effective in some wireline operations, when a formation tester is used in a MWD or LWD application, they have not performed as desired. Failure of conventional rubber pads has also been a concern in wireline applications that may require the performance of a large number of formation pressure tests during a single run into the wellbore, especially in wells having particularly harsh operating conditions. In a MWD or LWD environment, the formation tester is integrated into the drill string and is thus subjected to the harsh downhole environment for a much longer period than in a wireline testing application. In addition, during drilling, the formation tester is constantly rotated with the drill string and may contact the side of the wellbore and damage any exposed isolator pads. The pads may also be damaged during drilling by the drill cuttings that are being circulated through the wellbore by the drilling fluid.

Therefore, there remains a need in the art to develop an isolation pad that provides reliable sealing performance with an increased durability and resistance to damage. Therefore, the present invention is directed to methods and apparatus for isolator pad assemblies that effectively seal against a wellbore and are resistant to damage typically incurred during drilling operations. It is also an object of the present invention to provide an isolator pad assembly that has an extended life so as to enhance the number of tests that can be performed without replacing the pad.

SUMMARY OF THE PREFERRED EMBODIMENTS

Accordingly, there are provided herein methods and apparatus for isolator pad assemblies that comprise a primarily metallic pad member and a retractable resilient sealing member. The resilient sealing member is maintained in a retracted, protected position until extended to seal against the wellbore. Once extended to a sealing position, the resilient sealing member acts as a primary seal while the metallic pad member acts as a secondary seal.

One embodiment of a preferred isolator pad comprises a cylindrical outer sleeve that is sealingly engaged with a tool body and is capable of lateral translation in respect to the tool body. Affixed to the extending end of the outer sleeve is a metallic pad that has a contacting surface that is curved and preferably has a raised lip surrounding a penetration through the pad. An inner sleeve is slidingly engaged within the penetration through the pad and has a resilient ring molded to one end. The inner sleeve has an extended position wherein the resilient ring extends past the outer surface of the pad and a retracted position where the resilient ring does not extend past the surface of the pad.

Once the formation testing tool reaches the desired location in the wellbore, the tool is activated and the outer sleeve extended. The metallic pad engages the mudcake on the wellbore and compresses the mudcake until the raised lip contacts the formation. Once the outer sleeve and pad are extended, the inner sleeve extends so that the resilient ring contacts the mudcake. The contact between the resilient ring and the mudcake forms a primary seal to prevent wellbore fluids from entering the inner sleeve during a formation test. A secondary seal is formed by the metallic pad compressing the mudcake.

Thus, the present invention comprises a combination of features and advantages that enable it to reliably isolate a formation testing probe from wellbore fluids and protect the sealing arrangement from damage during the drilling process. These and various other characteristics and advantages of the present invention will be readily apparent to those skilled in the art upon reading the following detailed description of the preferred embodiments of the invention and by referring to the accompanying drawings.

BRIEF DESCRIPTION OF THE DRAWINGS

For a more detailed understanding of the preferred embodiments, reference is made to the accompanying Figures, wherein.

DETAILED DESCRIPTION OF THE PREFERRED EMBODIMENTS

Figure 1:
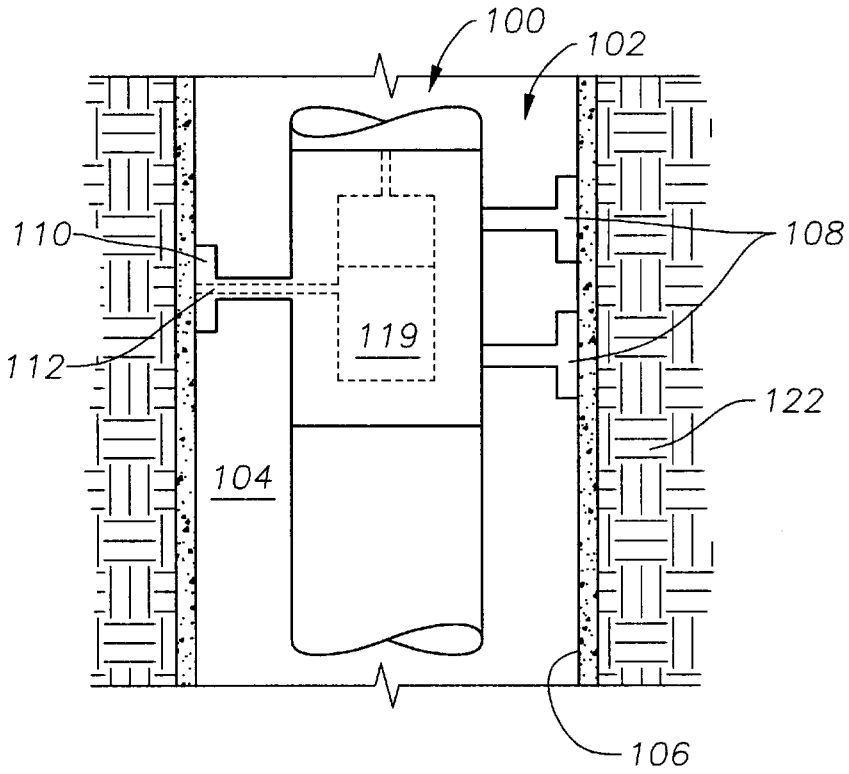
Fig. 1 (Prior Art)
FIG. 1 is a schematic representation of a prior art formation testing tool.

In the description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. In the following description, an extended position is taken to mean toward the wall of the wellbore and a retracted position is toward the center of the wellbore. Likewise, in some instances, the terms "proximal" and "proximally" refer to relative positioning toward the center of the wellbore, and the terms "distal" and "distally" refer to relative positioning toward the wall of the wellbore.

The present invention relates to methods and apparatus for seals that isolate a sample probe of a formation testing tool from wellbore fluids. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein. In particular, various embodiments of the present invention provide for isolator pad assemblies especially suited for use in MWD or LWD applications but these assemblies may also be used in wireline logging or other applications. Reference is made to using the embodiments of the present invention with a formation testing tool, but the concepts of the invention may also find use in any tool that seeks to acquire a sample of formation fluid that is substantially free of wellbore fluid. It is to be fully recognized that the different teachings of the embodiments discussed below may be employed separately or in any suitable combination to produce desired results.

Figure 2:
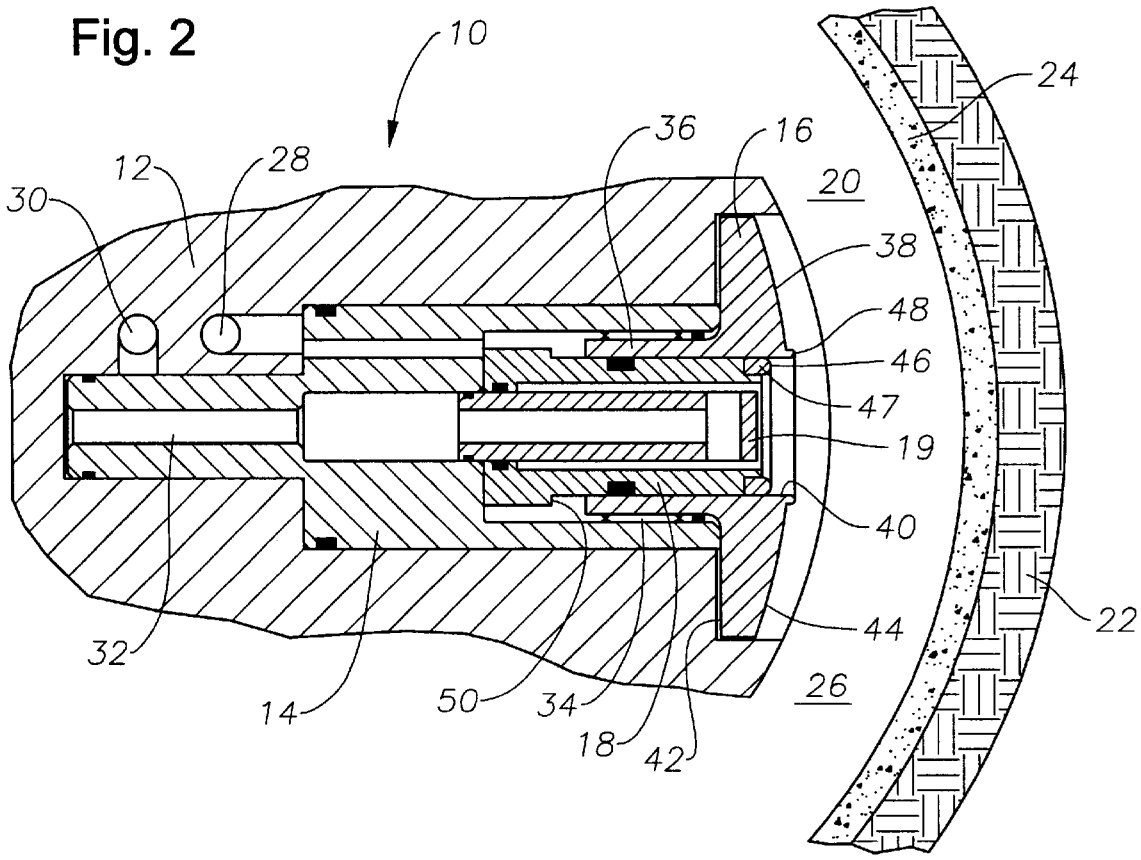
FIG. 2 is section view of one embodiment of an isolator probe assembly in a retracted position.

Referring now to FIG. 2, a cross-sectional view of one embodiment of an isolator probe assembly 10 is shown in a retracted position and housed a tool body 12. Assembly 10 generally comprises an outer sleeve 14, a pad member 16, an inner sleeve 18, and a bridging tube 19. Inner sleeve 18 is also known as a snorkel and includes filter 17. Assembly 10 and tool body 12 are shown disposed in a wellbore 20 drilled into a formation 22. The wall of wellbore 20 is coated with a mudcake 24 that is formed by the circulation of wellbore fluid 26 through the wellbore.

Tool body 12 has a substantially cylindrical body that is typical of tools used in downhole environments. Body 12 includes a hydraulic conduit 28 and a sample conduit 30 therethrough. Sample conduit 30 is in fluid communication with a drawdown chamber (not shown) whose volume can be varied by actuating one or more draw-down pistons (not shown), such as are known in the art. In this manner, the pressure in sample conduit 30 can be selectively controlled. Likewise, hydraulic conduit 28 is in fluid communication with a hydraulic power supply (not shown) that supplies hydraulic fluid to conduit 28.

Outer sleeve 14 of assembly 10 is a generally cylindrical and is disposed within a corresponding cavity in body 12. The outer surface of outer sleeve 14 includes a reduced diameter portion 13 extending toward the tool axis from a main portion 15. A shoulder 17 is defined between reduced diameter portion 13 and main portion 15. The outer surfaces of reduced diameter portion 13 and main portion 15 are in sealing engagement with the inner surface of the cavity in the tool body. Outer sleeve 14 is sealed to and slidable relative to tool body 12.

Outer sleeve 14 includes an axial central bore 32 therethrough. Central bore 32 includes a reduced diameter portion 33 within reduced diameter portion 13, an intermediate diameter portion 35, and a large diameter portion 37. Intermediate diameter portion 35 and large diameter portion 37 of bore 32 are within main portion 15 of outer sleeve 14. A proximal shoulder 31 is defined between reduced diameter portion 13 and intermediate diameter portion 35 and an intermediate shoulder 39 is defined between intermediate diameter portion 35 and large diameter portion 37. Central bore 32 is in fluid communication with sample conduit 30. A conduit 54 provides fluid communication between shoulder 17 on the outer surface of sleeve 14 and intermediate shoulder 39 in bore 32.

Pad 16 is preferably generally disc-shaped, with a substantially flat trailing side 42 and a cylindrically or spherically curved contact surface 44. The diameter of pad 16 is preferably greater than the largest diameter of outer sleeve 14. If desired, a recess 11 in tool body 12 is sized and configured to receive pad 16 so that no portion of assembly 10 extends beyond the outer surface of the tool body 12 when the assembly 10 is in its retracted position.

An annular stop member 36 extends from trailing side 42, away from the borehole wall. Annular stop member 36 defines a central bore 40, which has a uniform diameter along its length and which extends through pad 16. Stop member 36 is preferably affixed to the inner surface of large diameter portion 37 of bore 32 in outer sleeve 14 by means of threads 34 or other suitable device. A seal 65 is provided between stop member 36 and the inner surface of bore 32.

Pad 16 preferably includes a raised lip or boss 48 that extends outward from contact surface around the circumference of bore 40. Lip 48 preferably has a curved leading edge. Pad 16 is preferably constructed of a stainless steel or other corrosion resistant metal.

Inner sleeve 18 is a generally cylindrical body having a bore 21 therethrough. Near the proximal end of sleeve 18, the outer surface of sleeve 18 includes an enlarged diameter portion 23 forming a shoulder 25 and the inner surface of bore 21 includes a reduced diameter portion 27 forming a shoulder 29. Inner sleeve 18 also preferably includes filter 17 that serves to prevent large pieces of mudcake from entering bridging tube 19.

A resilient ring 46 is molded to the distal end of inner sleeve 18. Resilient ring 46 preferably has a radiused leading edge and is preferably molded to sleeve 18 such that only the base 47 of ring 46 is affixed to inner sleeve 18. Resilient ring 46 is preferably constructed from a resilient material such as rubber or a resilient polymer.

Inner sleeve 18 is received in bore 32 of outer sleeve 14 and is slidable therein. When the assembly 10 is in its retracted position, the proximal end of inner sleeve 18 bears on intermediate shoulder 39. The distal end of sleeve 18 extends into annular stop member 36 of pad 16 and is in slidable, sealing engagement with the inner surface of bore 40. Seal 67 prevents fluid flow along the interface between sleeve 18 and the inner surface of bore 40.

Bore 21 of inner sleeve 18 receives bridging tube 19. Bridging tube 19 is preferably cylindrical, with its outer diameter corresponding to the inner diameter of reduced diameter portion 27 of bore 21. Bridging tube 19 is in slidable, sealing engagement with bore 21 of inner sleeve 18 and intermediate diameter portion 35 of bore 32 in outer sleeve 14. Bridging tube 19 includes a fluid conduit 41 that provides fluid communication between bore 32 and bore 21. Conduit 41 preferably communicates with bore 32 via an axial opening 43 and with bore 21 via one or more lateral openings 45 at the distal end of tube 19. When assembly 10 is in its retracted position, as shown in FIG. 2, bridging tube 19 preferably extends almost to the distal edge of probe assembly 10 and filter 19 in order to prevent debris from collecting in the assembly. Bridging tube 19 may also be keyed to prevent rotation relative to inner sleeve 18 or outer sleeve 14.

Figure 3:
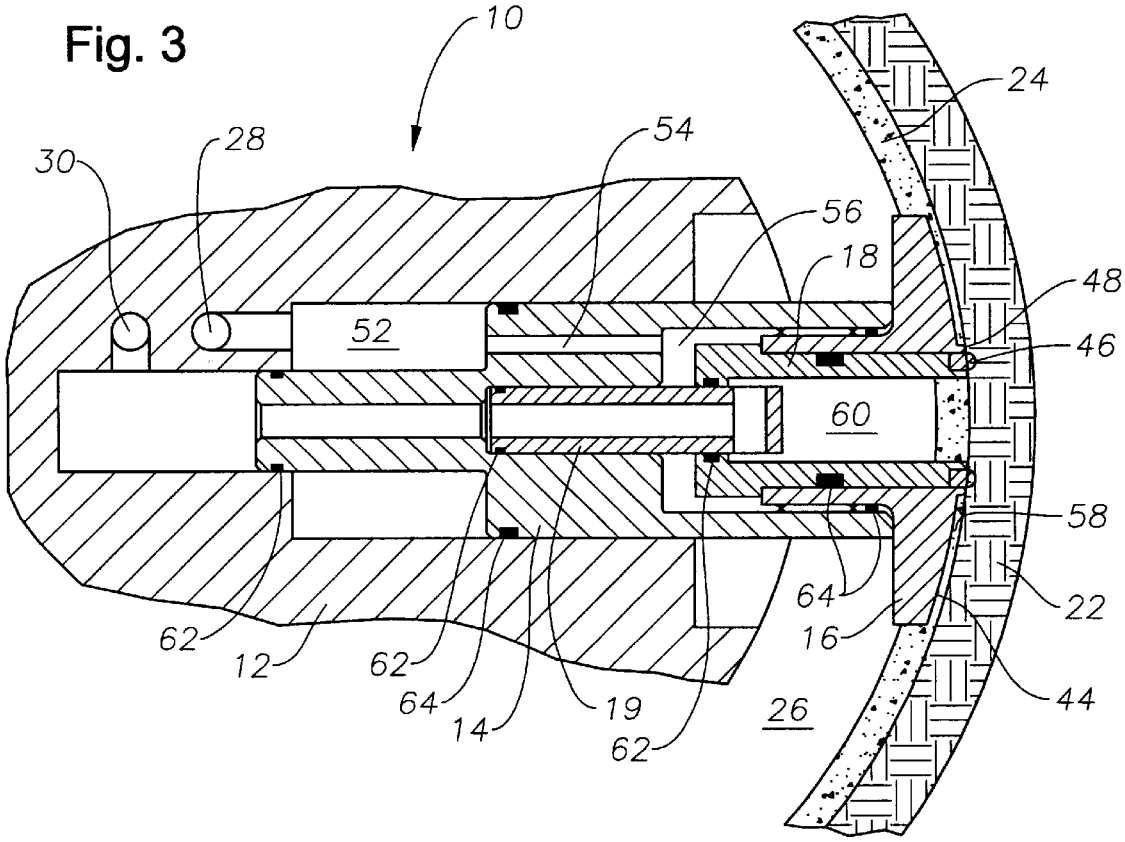
FIG. 3 is a section view of the embodiment of FIG. 2 shown in an extended position.

Referring now to FIG. 3, probe assembly 10 is extended by applying fluid pressure through hydraulic conduit 28 so that hydraulic pressure is applied between outer sleeve 14 and body 12. The pressure advances outer sleeve 14 pad 16 toward the wall of the wellbore. A hydraulic chamber 52 is defined between tool body 12 and outer sleeve 14 and between seals 62 and 64. Outer sleeve 14 and inner sleeve 18 are preferably arranged so that outer sleeve 14 extends before inner sleeve 18 extends. This may be achieved by arranged the respective pressure areas and adjusting the sliding friction relationships of sleeves 14, 18 so that it takes a greater fluid pressure to move inner sleeve 18 than the pressure required to move outer sleeve 14.

Thus, pad 16 is advanced through the mudcake 24 until raised lip 48 contacts the formation 22. Contact surface 44 of pad 16 compresses mudcake 24 against formation 22, forming a region 58 of mudcake that has very low permeability, thus forming a secondary seal. It is preferred that mudcake 24 be present on the wellbore wall to provide a compressible material that can form a seal with pad 16. Contact surface 44 of pad 16 may be smooth or rough.

As additional hydraulic fluid is pumped into hydraulic chamber 52 and through port 54 into large diameter portion 37 of bore 32, pressure increases behind inner sleeve 18, advancing it toward formation 22. A second hydraulic chamber 56 is defined between outer sleeve 14, inner sleeve 18, and bridging tube 19, and between seals 61, 63, 65 and 67. Inner sleeve 18 advances until resilient ring 46 is compressed against formation 22 and forms a primary seal. Bridging tube 19 preferably maintains a position that does not allow fluid flow into assembly 10 but is retracted to allow fluid to flow through filter 17 as the pressure within conduit 30 decreases.

In this manner, the combination of the primary seal created by resilient ring 46 and the secondary seal created by pad 16 hydraulically isolates the interior 60 of probe assembly 10 from wellbore fluid 26. Once the assembly 10 is in its extended position, a sample of formation fluid can be acquired by decreasing the pressure within sample conduit 30, which will allow fluid from formation 22 to flow through mudcake 24, into bore 21, through filter 17, into bridging tube 14, and thus into sample conduit 30. Once a suitable sample has been collected, probe assembly 10 can be returned to the retracted position by reducing the pressure within hydraulic conduit 28. Assembly 10 is preferably retractable by applying positive fluid pressure but may also be retracted using only hydrostatic pressure from the well.

Therefore, the above described extendable probe assembly provides a sealing pad that is protected from damage during the drilling process and can to take a plurality of samples during a single trip into the wellbore. The use of both primary and secondary sealing mechanisms also increases the reliability of the sealing system.

The embodiments set forth herein are merely illustrative and do not limit the scope of the invention or the details therein. It will be appreciated that many other modifications and improvements to the disclosure herein may be made without departing from the scope of the invention or the inventive concepts herein disclosed. Because many varying and different embodiments may be made within the scope of the inventive concept herein taught, including equivalent structures or materials hereafter thought of, and because many modifications may be made in the embodiments herein detailed in accordance with the descriptive requirements of the law, it is to be understood that the details herein are to be interpreted as illustrative and not in a limiting sense.

What is claimed is:

1. An isolator probe assembly for analyzing a formation through a wellbore lined with a mudcake, said assembly comprising:

an inner sleeve having a first end a resilient ring disposed on the first end of said inner sleeve and adapted to sealingly engage the wellbore to form a primary seal; and a pad having a shaped portion adapted to compress the mudcake against the wellbore to form a secondary seal, wherein said pad is adapted to receive said inner sleeve, said inner sleeve is moveable between a first position and second position.

2. An isolator probe assembly for analyzing a formation through a wellbore lined with a mudcake, said assembly comprising:

an inner sleeve having a first end a resilient ring disposed on the first end of said inner sleeve;

a pad having a shaped portion and adapted to receive said inner sleeve, wherein said inner sleeve is moveable between a first position and second position; and a raised lip protruding from the shaped portion of said pad.

3. The probe assembly of claim 1 wherein said resilient ring is recessed within said pad in the first position.

4. The probe assembly of claim 1 wherein said resilient ring protrudes from said pad in the second position.

5. The probe assembly of claim 1 wherein said shaped portion is curved in one direction.

6. An isolator probe assembly for analyzing a formation through a wellbore lined with a mudcake, said assembly comprising:

an inner sleeve having a first end a resilient ring disposed on the first end of said inner sleeve; and a pad having a shaped portion and adapted to receive said inner sleeve, wherein said inner sleeve is moveable between a first position and second position, wherein said shaped portion is curved in two directions.

7. The probe assembly of claim 1 further comprising a body adapted to receive said pad wherein said pad is moveable between a first and second position.

8. The probe assembly of claim 7 wherein said pad is moved by hydraulic force.

9. The probe assembly of claim 1 wherein said inner sleeve is moved by hydraulic force.

10. The probe assembly of claim 7 wherein said body is further adapted to collect a fluid sample through said inner sleeve.

11. A formation tester for analyzing a formation through a wellbore lined with a mudcake, said tester comprising:

a body;

a pad member having a shaped portion with a curved side thereon and a penetration therethrough;

a raised lip disposed on the shaped portion of said pad;

a sleeve member disposed within said penetration and moveable between a first position and a second position; and a resilient sealing member disposed on said sleeve member, wherein in the first position said resilient member is recessed within said pad and in the second position said resilient member extends beyond the curved side of said pad.

12. The formation tester of claim 11 further comprising:

a cavity disposed within said body and having a first portion and a second portion;

a hydraulic supply system connected to said first portion;

a sample collection system connected to said second portion; and an outer sleeve adapted to fit within said cavity and connected to said pad member.

13. A method for sealing an extendable probe assembly against a wellbore wall having a mudcake, the method comprising:

extending a pad to compress the mudcake;

extending an inner sleeve through the pad; and compressing a resilient ring disposed on said inner sleeve against the mudcake.

14. A method for sealing an extendable probe assembly against a wellbore wall having a mudcake, the method comprising:

extending a pad to compress the mudcake;

extending an inner sleeve through the pad; and compressing a resilient ring disposed on said inner sleeve against the mudcake wherein the pad has a raised lip.

15. A method for collecting a fluid sample from a formation through a wellbore lined with a mudcake, the method comprising:

disposing a formation tester into the wellbore;

extending a probe assembly to form a primary seal and a secondary seal that prevent wellbore fluids from entering the formation tester; and drawing a sample of fluid from the formation, through the probe assembly, and into the formation tester wherein the primary seal is created by compressing a resilient ring against the mudcake and the secondary seal is created by compressing the mudcake with a shaped pad, wherein the resilient ring and the shaped pad are moveable so as to extend outward from the probe assembly.

* * * * *

UNITED STATES PATENT AND TRADEMARK OFFICE

CERTIFICATE OF CORRECTION

PATENT NO. : 6,658,930 B2
DATED : December 9, 2003
INVENTOR(S) : Abbas Arian

It is certified that error appears in the above-identified patent and that said Letters Patent is hereby corrected as shown below:

Title page,
Item [75], Inventor, should read as follows:
-- Abbas Arian --

Signed and Sealed this

Sixth Day of April, 2004

JON W. DUDAS
*Acting Director of the United States Patent and Trademark Office*